United States Patent [19]

Ueba et al.

[11] Patent Number: 4,833,027

[45] Date of Patent: May 23, 1989

[54] STRING FOR A MUSICAL INSTRUMENT

[75] Inventors: Hisaaki Ueba, Omote; Yoshio Sunaga, Mibu, both of Japan

[73] Assignees: Kureha Kagaku Kogyo Kabushiki Kaisha, Tokyo; Kureha Gosen Co., Ltd., Tochigi, both of Japan

[21] Appl. No.: 27,923

[22] Filed: Mar. 19, 1987

[30] Foreign Application Priority Data

Mar. 24, 1986 [JP] Japan ..... 61-65537
Mar. 17, 1987 [JP] Japan ..... 62-61895

[51] Int. Cl.[4] ..... D02G 3/00

[52] U.S. Cl. ..... 428/364; 84/297 S; 526/255

[58] Field of Search ..... 428/364; 84/297 S; 526/255

[56] References Cited

U.S. PATENT DOCUMENTS

| | | | |
|---|---|---|---|
| 4,339,499 | 7/1982 | Tappe et al. | 84/297 S |
| 4,382,358 | 5/1983 | Tappe et al. | 525/72 X |
| 4,546,158 | 10/1985 | Mizuno et al. | 526/255 |
| 4,667,001 | 5/1987 | Mizuno | 526/255 |
| 4,670,527 | 6/1987 | Mizuno | 526/255 |

FOREIGN PATENT DOCUMENTS

| | | | |
|---|---|---|---|
| 48-43763 | 6/1973 | Japan | 526/255 |
| 53-95613 | 8/1978 | Japan . | |
| 53-95614 | 8/1978 | Japan . | |
| 53-95616 | 8/1978 | Japan . | |
| 2095166 | 9/1982 | United Kingdom . | |

OTHER PUBLICATIONS

Capbern, PCT Publication WO87/03018, 3/21/87.

*Primary Examiner*—Lorraine T. Kendell
*Attorney, Agent, or Firm*—Armstrong, Nikaido, Marmelstein, Kubovcik & Murray

[57] ABSTRACT

A string for a musical instrument consisting of a monofilament made of a resin of vinylidene fluoride and having the following characteristics which give good clearness of sound, good sharpness of sound and good spread of sound:

(1) the diameter of the monolfilament is in the range of 0.4 to 1.5 mm $\phi$;
(2) the unevenness of the diameter of the monofilament is less than 5% per meter of the monofilament length;
(3) the circularity of the section of the monofilament is more than 95%;
(4) the specific gravity is more than 1.6;
(5) the inherent viscosity is in the range of 1.1 to 1.6 dl/g;
(6) the apparent viscosity with the shear rate of 1/100 at 260° C. is in the range of 8000 to 20000 poises;
(7) the index of double refraction is in the range of $30\times10^{-3}$ to $40\times10^{-3}$;
(8) the tensile strength is more than 50 kg/mm$^2$;
(9) the ductility is in the range of 10 to 40%;
(10) the creep elongation limit with 20% load of the tensile strength is less than 10%; and
(11) the Young's modulus is more than 200 kg/mm$^2$.

14 Claims, 2 Drawing Sheets

STRING FOR A MUSICAL INSTRUMENT

BACKGROUND OF THE INVENTION

1. Field of the Invention:

This invention relates to a string for a musical instrument such as a guitar, a ukulele, a harp, a lute, a chembalo, a shamisen, a Japanese harp, and so on.

2. Description of the Prior Art:

For a string instrument, particularly for a classic guitar, a string made of nylon has been mainly used. However, since a nylon string on the market has the following problems, many of professional guitarists and lovers of guitar have been discontented with it.

A nylon string shows a relatively considerable change in tone with the passage of time because of its water absorbability, and as a result, it is hard to tune. In addition, because the string has absorbed water, the sound gets blurred and becomes unclear. Furthermore, the sound volume of such a nylon string is not enough because the energy of oscillation is small, and the tone has no depth and is liable to become monotonous.

In particular, tones of nylon strings on the market vary widely at every product. The percentage of the products which can be used as they are is only 30 to 50%. More than half of the products have need of shape correction with sand brush or the like to use.

In addition to nylon strings, various kinds strings have been proposed for string instruments. However, in any of the conventional strings, especially in any of the strings for guitars, the clearness of tone which may be expressed by the degree of approximation to a sine curve is insufficient. Besides, the sharpness of sound which may be expressed with the time till the amplitude of oscillation becomes stable into a constant value, and spread of sound which may be expressed with the duration of the constant amplitude are also insufficient. Moreover, undesirable trembling or vibration of sound peculiar to each string occasionally occurs.

SUMMARY OF THE INVENTION

Accordingly, it is an object of the present invention to provide a string for a musical instrument which shows good clearness of tone, good sharpness of sound and good spread of sound.

It is another object of the present invention to provide a string for a musical instrument which can be used without shape correction.

It is still another object of the present invention to provide a string for a musical instrument which shows little change of tone with the passage of time so as to be easy to tune.

The above and other objects can be attained by the invention as follows.

In the present invention, a string for a musical instrument consists of a monofilament made of resin of vinylidene fluoride which has the following properties:

(1) the diameter of the filament is in the range of 0.4 to 1.5 mm $\phi$;
(2) the unevenness of the diameter of the filament is less than 5% per meter of the filament length;
(3) the circularity of the section of the filament is more than 95%;
(4) the specific gravity is more than 1.6;
(5) the inherent viscosity is in the range of 1.1 to 1.6 dl/g;

(6) the apparent viscosity with the shear rate of 1/100 at 260° C. is in the range of 8000 to 20000 poises;
(7) the index of double refraction is in the range of $30\times10^{-3}$ to $40\times10^{-3}$;
(8) the tensile strength is more than 50 kg/mm$^2$;
(9) the ductility is in the range of 10 to 40%;
(10) the creep elongation limit with 20% load of the tensile strength is less than 10%; and
(11) the young's modulus is more than 200 kg/mm$^2$.

Other and further objects, features and advantages of the invention will be appear more fully from the following description.

DETAILED DESCRIPTION

First, the properties defined by the invention will be described.

(1) the diameter of the filament is in the range of 0.4 to 1.5 mm $\phi$:

The diameter of a filament of the invention is selected to obtain the required tone for each of strings of musical instruments. For example, the diameter of about 0.6mm is suitable for the first string of a classic guitar. The diameter of the filament is preferably in the range of 0.6 to 1.0 mm $\phi$.

The diameter of the filament defined in the invention may be determined by the manner of averaging the maximum diameters of ten samples of filaments each of which is measured from a microphotograph of the filament section of the sample.

(2) the unevenness of the diameter of the filament is less than 5% per meter of the filament length:

The unevenness of the filament diameter is for stabilizing the tone of the string and is a very important factor for strings of musical instruments as well as the circularity of the filament section described next. By defining the unevenness of the filament diameter into a value less than 5% per meter, the inequality or variation of tone of the string can be remarkably decreased so that it becomes easy to tune without shape correction. The unevenness of the filament diameter is preferably less than 3%, more preferably less than 2%.

Figure 2:
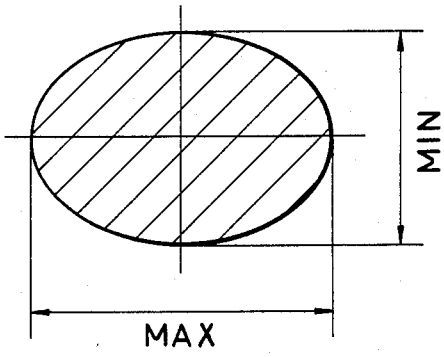
FIG. 2 is a sectional view of a string of the invention.

The unevenness of the filament diameter may be determined as follows. The maximum diameter (max) and minimum diameter (min) of the filament section as shown in FIG. 2 are measured at ten points in one meter of the filament, and then values which are calculated by the following expression with the maximum diameters and minimum diameters measured are averaged.

$$\frac{(\max)-(\min)}{\frac{(\max)+(\min)}{2}}\times 100\ (\%)$$

(3) the circularity of the section of the filament is more than 95%:

The circularity of the filament section is also an important factor for stabilizing the tone of the string. If the circularity is less than 95%, the tone of the string is not stable so the sound is not good. The circularity of the filament section is preferably more than 97%.

The circularity of the filament section defined in the invention may be determined by the manner of averaging values which are calculated by the following expression with the maximum diameters and minimum diameters of the filament sections measured from microphotographs of ten samples of filaments.

$$\left(1 - \frac{(\max) - (\min)}{\frac{(\max) + (\min)}{2}}\right) \times 100\ (\%)$$

(4) the specific gravity is more than 1.6:

The specific gravity has an influence upon the harmonic oscillation $\nu_K$ of the string through the following equation:

$$\nu_K = \frac{k}{2l}\sqrt{\frac{s}{\mu}}$$

where l is the length of the string, s is the tensile force, and k=1,2,3,.

The larger the specific gravity is, the larger the propagation velocity is. In addition, also the energy of the oscillation becomes larger so that sufficient sound volume can be obtained. The specific gravity $\mu$is preferably in the range of 1.7 to 1.8.

The specific gravity may be measured with a gradient tube using zinc chloride and distilled water at 20° C.

(5) the inherent viscosity is in the range of 1.1 to 1.6 dl/g:

(6) the apparent viscosity with the shear rate of 1/100 at 260° C. is in the range of 8000 to 20000 poises:

These two conditions are for manufacturing filaments suitable for strings of musical instruments. If the inherent viscosity is lower than 1.1 dl/g (0.85 to 1.1 dl/g), the creep of the filament becomes bad to lower the mechanical strength thereof. On the contrary, if the inherent viscosity is more than 1.6 dl/g, the viscosity becomes too high to work the filament. These reasons are similar to that for the apparent viscosity.

The inherent viscosity is preferably in the range of 1.1 to 1.4 dl/g. The apparent viscosity is preferably in the range of 10000 to 15000 poises.

(7) the index of double refraction is in the range of $30\times10^{-3}$ to $40\times10^{-3}$:

This condition is concerned with the tone of the string. The larger the index of double refraction is, the clearer the sound is. That is, the sound becomes crystal or metallic. If the index of double refraction is less than the above range, the sound gets blurred and feels bad. On the contrary, if the index of double refraction is more than the above range, the sound becomes too metalic and feels noisy. For example, a filament of polyvinylidene chloride is unsuitable for a string of a musical instrument because its index of double refraction does not enter the above range even in the case that it has the same specific gravity as that of polyvinylidene fluoride.

The index of double refraction is preferably in the range of $32\times10^{-3}$ to $39\times10^{-3}$, more preferably in the range of $35\times10^{-3}$ to $38\times10^{-3}$.

The index of double refraction is closely related with the drawing magnification in spinning process. When the drawing magnification is in the range of 6.0 to 6.8 (corresponding to the index of double refraction of $35\times10^{-3}$ to $38\times10^{-3}$), very clear sound can be obtained.

(8) the tensile strength is more than 50 kg/mm$^2$:

(9) the ductility is in the range of 10 to 40%:

These conditions show the mechanical strength of the filament suitable for a string of a musical instrument. The tensile strength is preferably in the range of 60 to 85 kg/mm$^2$, more preferably in the range of 70 to 80 kg/mm$^2$. The ductility is preferably in the range of 20 to 30%.

(10) the creep elongation limit with 20% load of the tensile strength is less than 10%:

This condition is concerned with the degree of aptitude of elongation of the filament. If the creep elongation limit is too large, when the string is tensioned, it elongates with the passage of time to change the tone thereof. The creep elongation limit is preferably in the range of 3 to 7%.

(11) the Young's modulus is more than 200 kg/mm$^2$:

Also the Young's modulus is concerned with solidity of sound. The larger the Young's modulus is, the sharper and the more crystal the sound is. If the Young's modulus is less than the above limit, the sound gets blurred and feels bad. The Young's modulus is preferably in the range of 250 to 350 kg/mm$^2$.

In addition to the above-described properties, in a string of the invention, the initial elastic modulus is preferably in the range of 200 to 500 kg/mm$^2$. The initial elastic modulus is more preferably in the range of 250 to 400 kg/mm$^2$, still more preferably in the range of 250 to 350 kg/mm$^2$.

Resin of vinylidene fluoride used in the invention may be copolymer of polyvinylidene fluoride containing more than 80 mole %, preferably more than 90 mole % of homopolymer or monomer of vinylidene fluoride, and other monomer copolymerizable with the polyvinylidene fluoride, for example, fluoride-contained olefin such as vinyl fluoride, ethylene chloride trifluoride, ethylene tetrafluoride and propylene hexafluoride.

The above resin can be used alone or, if need, with resin compatible with the resin of vinylidene fluoride, for example, plasticizer of polyester or phthalic acid, coloring material such as flavanthrone, or other material such as polymethyl methacrylate and polymethyl acrylate.

A filament made of resin of vinylidene fluoride used in the invention can be manufactured by the manner that the resin of vinylidene fluoride is melted, extruded, spun, cooled, drawn, and, if need, treated with heat.

Figure 1:
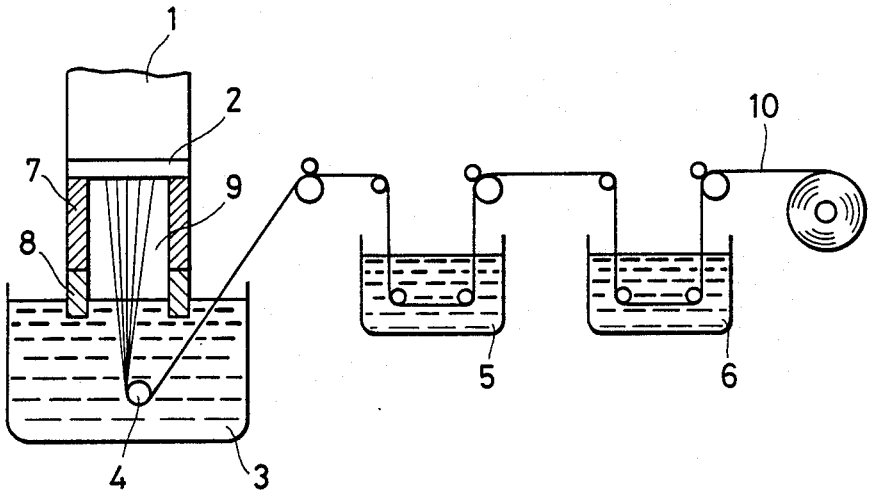
FIG. 1 is a schematic illustration showing an example of manufacturing process for a string of the invention.

Spinning of a filament made of resin of vinylidene fluoride used in the invention may be practiced with a spinning apparatus as shown in FIG. 1. Resin of vinylidene fluoride is melted at a temperature of, for example, 230 to 340° C., preferably 250 to 310° C. in an extruder 1, from which the resin melted is extruded through nozzles 2. In this case, generally, the extruder output per nozzle opening is selected as little as possible, for example, 0.005 to 3 g/min. The resin extruded is then passed through a cooling section 3 disposed by 2 cm to 1 m, preferably by 3 to 80 cm below nozzles 2 and kept at 60 to 100° C. Subsequently, the resin cooled is introduced with a guide roll 4 into a first bath 5 comprising, for example, glycerol at a temperature of 160° C. to be primarily drawn. The resin is then introduced into a second bath 6 comprising, for example, glycerol at a temperature of 160° C. to be secondarily drawn. Alternatively, the resin may be drawn by one step drawing. In either case of one step or two steps drawing, the resin is drawn at a drawing magnification of 4 to 10, preferably 6.0 to 6.8 and then the filament obtained is rolled up. The draft ratio is optional in the range of 5 to 2000. In the cooling section 3, liquid cooling with water or organic liquid is preferable but gas cooling may be effected.

In the above-described melt spinning process, while the resin of vinylidene fluoride is extruded, the atmosphere 9 between nozzles 2 and cooling section 3 must be as calm as possible. For this purpose, in the case of cooling section 3 comprising a liquid, it is preferable that the space between nozzles 2 and cooling section 3 for passing the resin extruded is surrounded by, for example, a heat-insulating mantle 7 made of suitable material and a cloth mantle 8 to exclude the outside air, as shown in FIG. 1. It is important that the resin of vinylidene fluoride which has been just extruded is prevented from disturbance as far as possible. By such an arrangement, a filament can be obtained in which the unevenness of the filament diameter is extremely low and the circularity of the filament section is high.

Upon using, a string of the invention may preferably be twisted by 40 to 200 times per meter for further improvement of its tone.

Hereinafter, experimental results will be described.

EXAMPLE 1

Pellets of homopolymer of vinylidene fluoride in which the inherent viscosity was 1.3 dl/g and the apparent viscosity with the shear rate of 1/100 at 260° C. was 11000 poises, were melted at a temperature of 280° C. and extruded at a rate of 30 g/min with an extruder 1 provided with nozzles 2 each having the diameter of 1 mm and the thickness of 20 mm.

The resin extruded was passed through a cooling section 3 which was disposed just below nozzles 2 and kept at 100° C. Subsequently, the resin was primarily drawn at a magnification of 5.4 in a first bath 5 comprising glycerol at 160° C. and then secondarily drawn at a magnification of 1.2 in a second bath 6 comprising glycerol at 160° C. to obtain a two steps-drawn filament having the diameter of 0.65 mm.

In this spinning process, the atmosphere 9 from nozzles 2 to the surface of cooling section 3, that is, the level of hot glycerol was insulated from the outside air and kept warm by disposing a heat-insulating mantle 7 at the upper side and a cloth mantle 8 at the lower side to prevent the resin from disturbance.

The two steps-drawn filament 10 obtained was then treated with heat in a hot glycerol bath at 170° C. with such a tension that the drawing of 10% by 2 seconds occurs to obtain a filament having the diameter of 0.63 mm, the mean index of double refraction of $32\times10^{-3}$ and the specific gravity of 1.78.

The properties of this filament measured were as follows. The apparent Young's moduls was 270 kg/mm$^2$.The tensile strength was 80 kg/mm$^2$. The ductility was 35%. The creep elongation limit with 16 kg/mm$^2$(20% of the tensile strength) was 6.8%.

The unevenness of the diameter of this filament was 2.9% per meter. The circularity of the section of this filament was 98.7%.

Figure 3A:
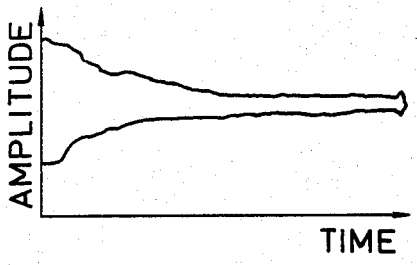
FIGS. 3A and 3B are graphs showing envelopes of damping curves of a string according to an embodiment of the invention.
Figure 3B:
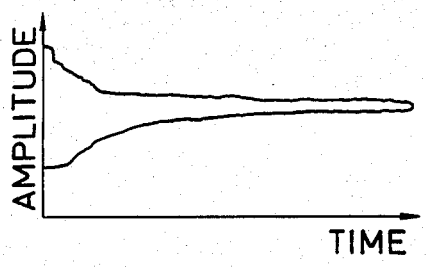
Figure 5A:
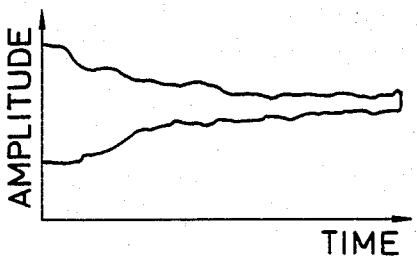
FIGS. 5A and 5B are graphs showing envelopes of damping curves of a nylon string on the market.
Figure 5B:
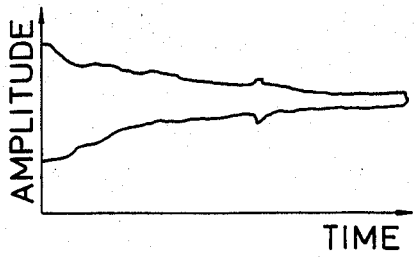

When a filament to this example was tensioned as the first string of a classic guitar, the damping curves were observed with an oscillograph immediately after tensioning and 24 hours after tensioning, respectively. Envelopes obtained from those curves are shown in FIGS. 3A and 3B, respectively. For comparison, envelopes obtained similarly to that of this example but a nylon string on the market was used are shown in FIGS. 5A and 5B. In these drawings, FIGS. 3A and 5A show envelopes of the damping curves obtained immediately after tensioning, and FIGS. 3B and 5B show envelopes of the damping curves obtained 24 hours after tensioning.

As apparent from FIGS. 3 and 5, a string of this example becomes stable into a constant amplitude earlier than a nylon string on the market. Therefore, it is realized that a string of this example is superior in sharpness and spread of sound to a conventional nylon string.

In practice, when a string of this example was used as the first string of a classic guitar, the tone was clearer than that of a nylon string on the market, and did not feel blurred. In addition, the string of this example was easy to tune. Further, undesirable trembling or vibration of sound did not occur so that good sound was obtained.

In contrast to this, the nylon string on the market in which the specific gravity was 1.14, the unevenness of the filament diameter was 9% per meter and the circularity of the filament section was 89%, was insufficient in clearness of sound and felt blurred. In addition, undesirable trembling and vibration of sound were observed.

EXAMPLE 2

A filament having the properties shown in Table 1 was obtained by the similar manner to that of Example 1 but the diameter of each nozzle was 3 mm.

TABLE 1

| | |
|---|---|
| specific gravity | 1.78 |
| diameter | 0.60 mm |
| unevenness per meter | 1.5% |
| circularity | 97.8% |
| inherent viscosity | 1.3 dl/g |
| apparent viscosity (shear rate of 1/100 at 260° C.) | 11000 poises |
| index of double refraction | $36\times10^{-3}$ |
| initial modulus | 290 kg/mm$^2$ |
| tensile strength | 75 kg/mm$^2$ |
| ductility | 25.3% |
| creep elongation limit | 6.2% |
| apparent Young's modulus | 305 kg/mm$^2$ |

Figure 4A:
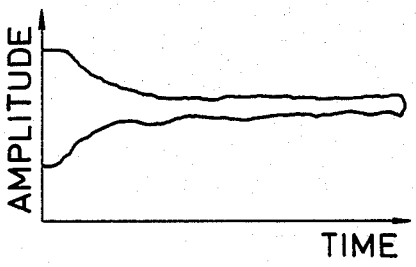
FIGS. 4A and 4B are graphs showing envelopes of damping curves of a string according to another embodiment of the invention.
Figure 4B:
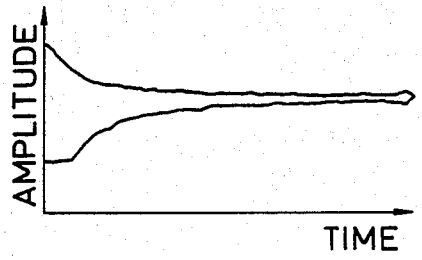

When a filament of this example was tensioned as the first string of a classic guitar, the damping curves were observed similarly to Example 1. Envelopes obtained from those curves are shown in FIGS. 4A and 4B. FIG. 4A shows an envelope of curves obtained immediately after tensioning and FIG. 4B shows an envelope of curves obtained 24 hours after tensioning.

As apparent from these drawings, a string of this example becomes stable into a constant amplitude earlier than a nylon string on the market, similarly to that of Example 1. Therefore, it is realized that also a string of this example is superior in sharpness and spread of sound.

EXAMPLE 3

Strings of polyvinylidene fluoride each having the properties shown in Table 2 were used in comparative experiments.

TABLE 2

| | |
|---|---|
| specific gravity | 1.78 |

TABLE 2-continued

| | |
|---|---|
| diameter | 0.60 mm |
| inherent viscosity | 1.3 dl/g |
| apparent viscosity (shear rate of 1/100 at 260° C.) | 11000 poises |
| index of double refraction | $35.5 \times 10^{-3}$ |
| initial modulus | 270 kg/mm$^2$ |
| tensile strength | 72.3 kg/mm$^2$ |
| ductility | 29.4% |
| creep elongation limit | 6.9% |

Using strings of polyvinylidene fluoride (V.F.) of this example and nylon strings on the market; organoleptic tests by seven specialists in guitar were practiced. The room temperature was 20° C. ±2° C. and the humidity was 55%±5%. A classic guitar on the market was used and strings were tuned in 1320 Hz (E), 1584 Hz (G), 1760 Hz (A) and 1980 Hz (B), respectively.

Results in the case that the circularity was fixed and the unevenness was varied are shown in Table 3.

TABLE 3

| | the unevenness is high | | the unevenness is low | |
|---|---|---|---|---|
| | V.F. (Com. Ex.) | nylon (Com. Ex.) | V.F. (Embodiment) | nylon (Com. Ex.) |
| unevenness | 7.5% | 7.48% | 0.59% | 0.36% |
| circularity | 99% | 99% | 99% | 99% |
| estimation of sound | 2.48 | 3.08 | 1.21 | 2.25 |

The estimation of sound is the average of points when good sound, the medium quality of sound, slightly bad sound and bad sound are estimated at 1,2,3 and 4 points, respectively.

As apparent from this result, the degree of unevenness of the filament diameter has a large influence upon the estimation of sound. The string according to an embodiment of the invention was remarkably superior in the estimation of sound to the others.

Next, results in the case that the unevenness was fixed and the circularity was varied are shown in Table 4.

TABLE 4

| | the circularity is large | | the circularity is small | |
|---|---|---|---|---|
| | V.F. (Embodiment) | nylon (Com. Ex.) | V.F. (Com. Ex.) | nylon (Com. Ex.) |
| circularity | 99% | 99% | 92.5% | 92.6% |
| unevenness | 0.62% | 0.58% | 0.59% | 0.61% |
| estimation of sound | 1.76 | 2.66 | 2.80 | 3.33 |

As apparent from this result, also the circularity has a large influence upon the estimation of sound and the string according to an embodiment of the invention was remarkably superior to the others.

In experiments other than the above-described ones, when the both ends of a string were fixed and the string was oscillated, the damping curves were displayed on an oscillograph. The images displayed were photographed to be investigated. As the result, in case of a nylon string on the market in which the unevenness of the filament diameter and the circularity of the filament section were insufficient, other than the fundamental wave of 333 Hz, waves of very shorter wavelengths such as 2083 Hz, 2128 Hz, etc. were detected. In contrast to this, in case of a string according to an embodiment of the invention, other than the fundamental wave, only waves of 543 Hz and 568 Hz at the highest were detected. Also from this fact, it is realized that clear sound can be obtained with a string of the invention.

As many apparently widely different embodiments of this invention may be made without departing from the spirit and scope thereof, it is to be understood that the invention is not limited to the specific embodiments thereof except as defined in the appended claims.

What is claimed is:

1. A string for a musical instrument consisting of a monofilament made of a resin of vinylidene fluoride which has the following properties:

(1) the diameter of the monofilament is in the range of 0.4 to 1.5 mm $\phi$;

(2) the unevenness of the diameter of the monofilament is less than 5% per meter of the monofilament length;

(3) the circularity of the section of the monofilament is more than 95%;

(4) the specific gravity is more than 1.6;

(5) the inherent viscosity is in the range of 1.1 to 1.6 dl/g;

(6) the apparent viscosity with the shear rate of 1/100 at 260° C. is in the range of 8000 to 20000 poises;

(7) the index of double refraction is in the range of $30\times10^{-3}$ to $40\times10^{-3}$;

(8) the tensile strength is more than 50 kg/mm$^2$;

(9) the ductility is in the range of 10 to 40%;

(10) the creep elongation limit with 20% load of the tensile strength is less than 10%; and

(11) the Young's modulus is more than 200 kg/mm$^2$.

2. A string according to claim 1, wherein the unevenness of the diameter of the monofilament is less than 3% per meter.

3. A string according to claim 2, wherein the unevenness of the diameter of the monofilament is less than 2% per meter.

4. A string according to claim 1, wherein the circularity of the section of the monofilament is more than 97%.

5. A string according to claim 1, wherein the specific gravity is in the range of 1.7 to 1.8.

6. A string according to claim 1, wherein the inherent viscosity is in the range of 1.1 to 1.4.

7. A string according to claim 1, wherein the apparent viscosity with the shear rate of 1/100 at 260° C. is in the range of 10000 to 15000.

8. A string according to claim 1, wherein the index of double refraction is in the range of $32\times10^{-3}$ to $39\times10^{-3}$.

9. A string according to claim 8, wherein the index of double refraction is in the range of $35\times10^{-3}$ to $38\times10^{-3}$.

10. A string according to claim 1, wherein the tensile strength is in the range of 60 to 85 kg/mm$^2$.

11. A string according to claim 1, wherein the ductility is in the range of 20 to 30%.

12. A string according to claim 1, wherein the creep elongation limit with 20% load of the tensile strength is in the range of 3 to 7%.

13. A string according to claim 1, wherein the Young's modulus is in the range of 250 to 350 kg/mm$^2$.

14. A string according to claim 1, wherein said resin of vinylidene fluoride comprises a copolymer of polyvinylidene fluoride containing more than 80 mole % of homopolymer or monomer of vinylidene fluoride, and another monomer copolymerizable with said polyvinylidene fluoride selected from the group of vinyl fluoride, ethylene chloride trifluoride, ethylene tetrafluoride and propylene hexafluoride.

* * * * *